US011597623B2

(12) United States Patent
Tao et al.

(10) Patent No.: US 11,597,623 B2
(45) Date of Patent: Mar. 7, 2023

(54) CABLE TENSION CONTROL DEVICE

(71) Applicants: Tyco Electronics (Shanghai) Co. Ltd., Shanghai (CN); TE Connectivity Corporation, Berwyn, PA (US)

(72) Inventors: Zongjie Tao, Shanghai (CN); Dandan Zhang, Shanghai (CN); Roberto Francisco-Yi Lu, Bellevue, WA (US); Yingcong Deng, Shanghai (CN); Zhonghua Xu, Shanghai (CN)

(73) Assignees: TE Connectivity Solutions GmbH, Schaffhausen (CH); TE Connectivity Co. Ltd., Shanghai (CN)

( * ) Notice: Subject to any disclaimer, the term of this patent is extended or adjusted under 35 U.S.C. 154(b) by 260 days.

(21) Appl. No.: 16/942,413

(22) Filed: Jul. 29, 2020

(65) Prior Publication Data

US 2021/0032068 A1 Feb. 4, 2021

(30) Foreign Application Priority Data

Jul. 29, 2019 (CN) ..... 201921203403.0

(51) Int. Cl.
*B65H 59/36* (2006.01)
*B65H 51/10* (2006.01)
*B65H 59/38* (2006.01)

(52) U.S. Cl.
CPC ..... *B65H 59/36* (2013.01); *B65H 51/10* (2013.01); *B65H 59/388* (2013.01); *B65H 2513/10* (2013.01)

(58) Field of Classification Search
CPC ..... B65H 59/36; B65H 59/388; B65H 51/10; B65H 2513/10
See application file for complete search history.

(56) References Cited

U.S. PATENT DOCUMENTS 3,613,975 A * 10/1971 Knight ..... B65H 59/388 318/7
4,242,556 A * 12/1980 Ullmann ..... B23H 7/10 219/69.12

* cited by examiner

*Primary Examiner* — William E Dondero
(74) *Attorney, Agent, or Firm* — Barley Snyder

(57) ABSTRACT

A cable tension control device includes a pair of first active rollers clamping a cable therebetween, a first driver driving the first active rollers, a pair of second active rollers clamping the cable therebetween at an upstream position from the first active rollers, a second driver driving the second active rollers, a floating roller arranged between the first active rollers and the second active rollers and exerting a pushing force on the cable, and an actuator driving the floating roller to move vertically to adjust the pushing force exerted on the cable. A tension force applied on the cable is controlled to be equal to a predetermined tension force by controlling the pushing force and by controlling a speed difference between a first speed at which the first active rollers convey the cable forward and a second speed at which the second active rollers convey the cable forward.

13 Claims, 1 Drawing Sheet

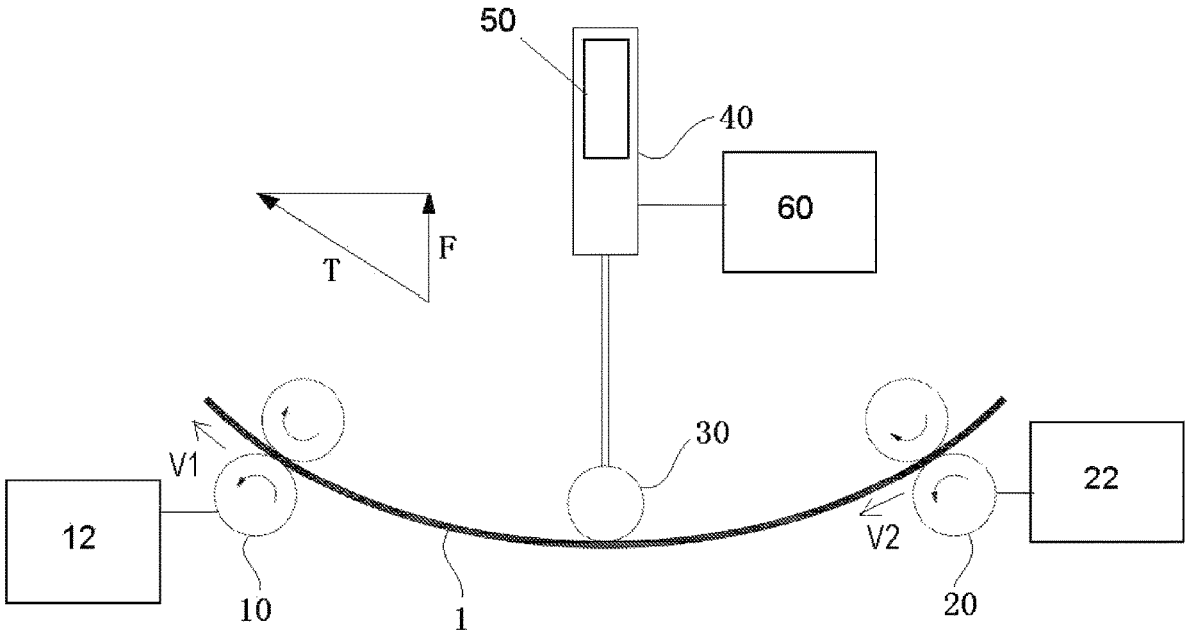
50
40
60
T
F
V1
30
22
12
V2
10
1
20

CABLE TENSION CONTROL DEVICE

CROSS-REFERENCE TO RELATED APPLICATION

This application claims the benefit of the filing date under 35 U.S.C. § 119(a)-(d) of Chinese Patent Application No. 201921203403.0, filed on Jul. 29, 2019.

FIELD OF THE INVENTION

The present disclosure relates to a tension control device and, more particularly, to a cable tension control device.

BACKGROUND

In order to convey a cable stably, a proper tension force must be applied on the cable. In the prior art, the tension force applied on the cable is usually adjusted by moving a tension roller. However, this adjustment mode will cause the tension force applied on the cable to be unstable, prone to fluctuation, and disadvantageously affect the transmission of the cable.

SUMMARY

A cable tension control device includes a pair of first active rollers clamping a cable therebetween, a first driver driving the first active rollers, a pair of second active rollers clamping the cable therebetween at an upstream position from the first active rollers, a second driver driving the second active rollers, a floating roller arranged between the first active rollers and the second active rollers and exerting a pushing force on the cable, and an actuator driving the floating roller to move vertically to adjust the pushing force exerted on the cable. A tension force applied on the cable is controlled to be equal to a predetermined tension force by controlling the pushing force and by controlling a speed difference between a first speed at which the first active rollers convey the cable forward and a second speed at which the second active rollers convey the cable forward.

BRIEF DESCRIPTION OF THE DRAWINGS

The above and other features of the present disclosure will become more apparent by describing in detail exemplary embodiments thereof with reference to the accompanying drawings, in which:

FIG. 1 is a schematic diagram of a cable tension control device according to an embodiment.

DETAILED DESCRIPTION OF THE EMBODIMENT(S)

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

A cable tension device according to an embodiment, as shown in FIG. 1, comprises at least one pair of first active rollers (or referred to as front driving rollers) 10, a first driver 12, at least one pair of second active rollers (or referred to as rear driving rollers) 20, a second driver 22, a floating roller 30, and an actuator 40. The at least one pair of first active rollers 10 is configured to clamp a cable 1 therebetween. The first driver 12 is adapted to drive the first active rollers 10 to rotate, so as to convey the cable 1 forward. The at least one pair of second active rollers 20 is configured to clamp the cable 1 therebetween at an upstream position from the first active rollers 10. The second driver 22 is adapted to drive the second active rollers 20 to rotate, so as to convey the cable 1 forward. The floating roller 30 is arranged between the first active roller 10 and the second active roller 20 and configured to exert a pushing force on the cable 1. The actuator 40 is adapted to drive the floating roller 30 to move vertically so as to adjust the pushing force exerted on the cable 1 by the floating roller 30.

As shown in FIG. 1, the cable tension control device is adapted to control a tension force applied on the cable 1 by controlling the pushing force exerted on the cable 1 by the floating roller 30, and by controlling a speed difference between a first speed at which the first active rollers 10 convey the cable 1 forward and a second speed at which the second active rollers 20 convey the cable 1 forward, so that the tension force T applied on the cable 1 can be controlled to be equal to a predetermined tension force.

As shown in FIG. 1, in an exemplary embodiment of the present disclosure, the first active rollers 10 convey the cable 1 forward at a first speed V1 and the second active rollers 20 convey the cable 1 forward at a second speed V2. The first speed V1 is greater than the second speed V2. In the present disclosure, by controlling the speed difference between the first speed V1 and the second speed V2 and by controlling the pushing force F exerted on the cable 1 by the floating roller 30, the tension force T applied on the cable 1 may be kept constant.

As shown in FIG. 1, in an exemplary embodiment of the present disclosure, if the tension force T applied on the cable 1 is equal to the predetermined tension force, and if the pushing force F exerted on the cable 1 by the floating roller 30 is equal to a predetermined pushing force, the speed difference between the first active rollers 10 conveying the cable 1 forward and the second active rollers 20 conveying the cable 1 forward, that is, the speed difference between the first speed V1 and the second speed V2, will be equal to a predetermined speed difference.

As shown in FIG. 1, in an embodiment, the first active roller 10 and the second active roller 20 are located at the same height position, and the floating roller 30 is located at a middle position between the first active roller 10 and the second active roller 20.

In an embodiment, the cable tension control device further comprises a sensor 50. The sensor 50 may be provided on the actuator 40. The sensor 50 is adapted to detect a movement amount of the floating roller 30 in a vertical direction. In an embodiment, the cable tension control device further comprises a controller 60. The controller 60 is adapted to adjust and control a driving force of the actuator 40 according to the movement amount detected by the sensor 50, such that the pushing force F exerted on the cable 1 by the floating roller 30 is equal to the predetermined pushing force.

In an embodiment, the first driver 12 and the second driver 22 may be electric motors. In an embodiment, the actuator 40 may be an air cylinder, a hydraulic cylinder, or a servo motor.

Hereafter, a process of adjusting the tension force applied on the cable 1 to the predetermined tension force will be described with reference to FIG. 1.

First, the first active rollers 10 clamp the cable 1 therebetween, and the second active rollers 20 clamp the cable therebetween.

Then, the predetermined pushing force is exerted on the cable 1 by the floating roller 30.

Then, the first speed at which the first active rollers (the front active rollers) 10 convey the cable 1 forward is adjusted so that it is equal to a predetermined cable conveying speed.

Finally, the second speed at which the second active rollers (the rear active rollers) 20 convey the cable 1 forward is adjusted so that the speed difference between the first speed of the first active rollers and the second speed of the second active rollers 20 is equal to the predetermined speed difference.

In this way, it may ensure that the tension force applied on the cable 1 is equal to the predetermined tension force.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A cable tension control device, comprising:

a pair of first active rollers clamping a cable therebetween;

a first driver driving the first active rollers to rotate so as to convey the cable forward;

a pair of second active rollers clamping the cable therebetween at an upstream position from the first active rollers;

a second driver driving the second active rollers to rotate so as to convey the cable forward;

a floating roller arranged between the first active rollers and the second active rollers and exerting a pushing force on the cable; and an actuator driving the floating roller to move vertically to adjust the pushing force exerted on the cable, a tension force applied on the cable is controlled to be equal to a predetermined tension force by controlling the pushing force and by controlling a speed difference between a first speed at which the first active rollers convey the cable forward and a second speed at which the second active rollers convey the cable forward.

2. The cable tension control device according to claim 1, wherein, if the tension force applied on the cable is equal to the predetermined tension force and the pushing force exerted on the cable is equal to a predetermined pushing force, the speed difference between the first speed and the second speed is equal to a predetermined speed difference.

3. The cable tension control device according to claim 2, wherein the first active rollers and the second active rollers are located at a same height position.

4. The cable tension control device according to claim 3, wherein the floating roller is located at a middle position between the first active rollers and the second active rollers.

5. The cable tension control device according to claim 2, further comprising a sensor provided on the actuator.

6. The cable tension control device according to claim 5, wherein the sensor detects a movement amount of the floating roller in a vertical direction.

7. The cable tension control device according to claim 5, further comprising a controller adjusting and controlling a driving force of the actuator.

8. The cable tension control device according to claim 7, wherein the controller adjusts and controls the driving force according to a movement amount detected by the sensor, such that the pushing force is equal to the predetermined pushing force.

9. The cable tension control device according to claim 2, wherein, if the tension force applied on the cable is equal to the predetermined tension force, the first speed is greater than the second speed and the first speed is equal to a predetermined cable conveying speed.

10. The cable tension control device according to claim 1, wherein the first active rollers and the second active rollers are located at a same height position.

11. The cable tension control device according to claim 10, wherein the floating roller is located at a middle position between the first active rollers and the second active rollers.

12. The cable tension control device according to claim 1, wherein the first driver and the second driver are electric motors.

13. The cable tension control device according to claim 1, wherein the actuator is an air cylinder, a hydraulic cylinder, or a servo motor.

* * * * *